US006812947B2

(12) United States Patent
Rassatt et al.

(10) Patent No.: US 6,812,947 B2
(45) Date of Patent: Nov. 2, 2004

(54) CONTAMINANT REMOVAL SYSTEM IN A THERMAL PROCESSOR

(75) Inventors: Bradley B. Rassatt, Apple Valley, MN (US); David J. McDaniel, Vdnais Heights, MN (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/376,547

(22) Filed: Feb. 28, 2003

(65) Prior Publication Data

US 2004/0169714 A1 Sep. 2, 2004

(51) Int. Cl.[7] ..... B41J 2/435
(52) U.S. Cl. ..... 347/228
(58) Field of Search ..... 347/140, 165, 347/228, 262, 263, 264; 219/216; 399/328, 330; 430/33, 97, 99

(56) References Cited

U.S. PATENT DOCUMENTS

| | | | | | |
|---|---|---|---|---|---|
| 3,757,662 | A | * | 9/1973 | Ingels | 219/216 |
| 5,790,069 | A | * | 8/1998 | McDaniel et al. | 347/263 |
| 5,946,025 | A | | 8/1999 | Allen | 347/262 |

FOREIGN PATENT DOCUMENTS

| | | |
|---|---|---|
| JP | 06332142 | 2/1994 |
| WO | WO 97/21150 | 6/1997 |

* cited by examiner

*Primary Examiner*—Hai Pham
(74) *Attorney, Agent, or Firm*—William F. Noval

(57) ABSTRACT

A thermal processor having a contaminant removal system. The system includes a heated drum for heat developing exposed heat developable media which emit airborne contaminants during the development; a plurality of rollers located about a circumferential segment of the drum to hold an exposed media in contact with the drum; an enclosure for enclosing the heated drum and plurality of rollers, the enclosure including a first upper curved member spaced from and enclosing the rollers and the upper portion of the drum and a second lower curved member spaced from and enclosing the lower portion of the drum, the first and second curved members having first ends spaced from each other and defining a film entrance region, and further having second ends spaced from each other and defining a film exit region; wherein the first upper curved member includes a curved duct having a first opening above the rollers and a second opening configured to direct gaseous fluids away from the film exit from the drum. The system further includes a top condensation trap communicating with the second opening of the duct; a bottom condensation trap; and an air flow control system for drawing ambient air from outside the enclosure through the film entrance region, splitting the air flow into (a) a top flow stream which passes between the first member over the rollers, through the duct and through the top condensation trap where airborne contaminants are condensed and the air stream is cooled, and (b) a bottom flow stream which passes between the second member and the lower portion of the drum and through the bottom condensation trap where airborne contaminants are condensed and the bottom flow stream is cooled.

6 Claims, 3 Drawing Sheets

CONTAMINANT REMOVAL SYSTEM IN A THERMAL PROCESSOR

FIELD OF THE INVENTION

This invention relates in general to laser imaging systems and more particularly to a contaminant removal system in a thermal processor of a photothermographic laser imaging system.

BACKGROUND OF THE INVENTION

Laser imaging systems are widely used in commercial, industrial, and medical imaging fields. In the medical imaging field, photothermographic laser imaging systems are used to reproduce digital medical images in heat processable photothermographic film. After the film is exposed to a digital medical image, the film is processed by a thermal processor to produce a visual representation of the medical image on the film. The thermal processor includes a rotatable heated drum having circumferentially arrayed pressure rollers to hold the film in contact with the heated drum during development. After development, the film is cooled and output to a user.

During the heat development process of the exposed photothermographic media, air-borne contaminants are produced that can produce image artifacts in the developed film image. Airflow in the exit region from the drum has resulted in image artifacts that have a Christmas tree type of profile or wispy appearance.

There is thus a need for improving air contaminant removal in heated drum thermal processors in order to minimize image artifacts in developed film.

SUMMARY OF THE INVENTION

According to the present invention, there is provided a solution to these problems.

According to an aspect of the present invention there is provided, a thermal processor having a contaminant removal system comprising: a heated drum for heat developing exposed heat developable media which emit air-borne contaminants during said development; a plurality of rollers located about a circumferential segment of said drum to hold an exposed media in contact with said drum; an enclosure for enclosing said heated drum and plurality of rollers, said enclosure including a first upper curved member spaced from and enclosing said rollers and the upper portion of said drum and a second lower curved member spaced from and enclosing said lower portion of said drum, said first and second curved members having first ends spaced from each other and defining a film entrance region, and further having second ends spaced from each other and defining a film exit region; wherein said first upper curved member includes a curved duct having a first opening above said rollers and a second opening configured to direct gaseous fluids away from the film exit from said drum; a top condensation trap communicating with said second opening of said duct; a bottom condensation trap; and an air flow control system for drawing ambient air from outside said enclosure through said film entrance region, splitting said air flow into (a) a top flow stream which passes between said first member over said rollers, through said duct and through said top condensation trap where air-borne contaminants are condensed and said air stream is cooled, and (b) a bottom flow stream which passes between said second member and said lower portion of said drum and through said bottom condensation trap where air-borne contaminants are condensed and said bottom flow stream is cooled.

ADVANTAGEOUS EFFECT OF THE INVENTION

The invention has the following advantages.

1. Air contaminants produced during development of heat processable exposed media in a heated drum thermal processor are removed in an efficient and cost effective manner.

2. Image artifacts are minimized in heat developed exposed media.

3. Air temperature is minimized at the filter inlet thus increasing filter life and effectiveness.

DETAILED DESCRIPTION OF THE INVENTION

Figure 1:
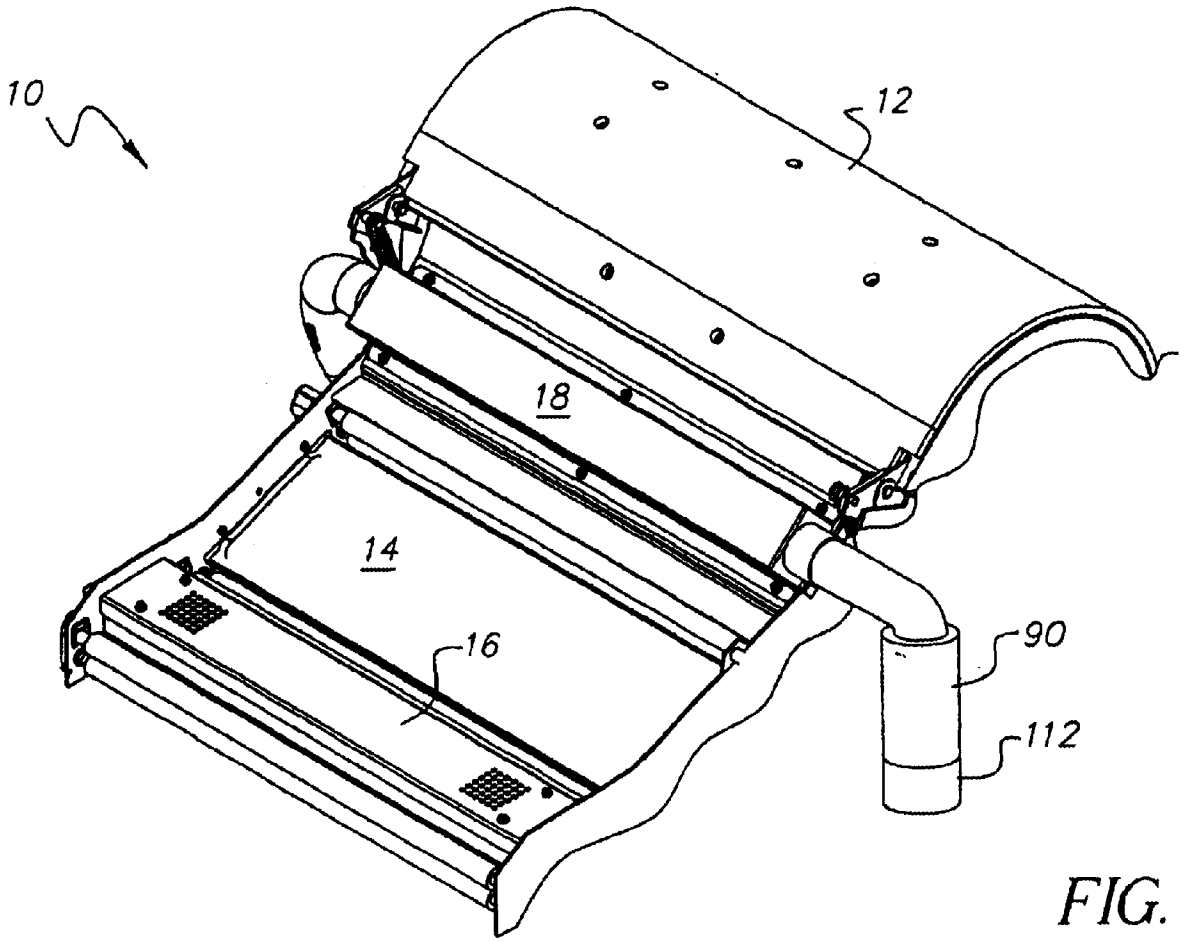
FIG. 1 is a perspective view of a heated drum thermal processor incorporating the present invention.

Referring now to FIG. 1, there is shown a thermal processor incorporating an embodiment of the present invention. As shown, thermal processor 10 generally includes a heated drum assembly 12, a film cooling section 14, densitometer 16, and airborne contaminant removal system 18. In operation, an exposed photothermographic media is heat developed by heated drum assembly 12. The heated media is cooled while passing over cooling section 14. Densitometer 16 reads the density control patches on developed media before the media is output to a user. System 18 removes airborne contaminants produced during the heat development process.

Figure 2:
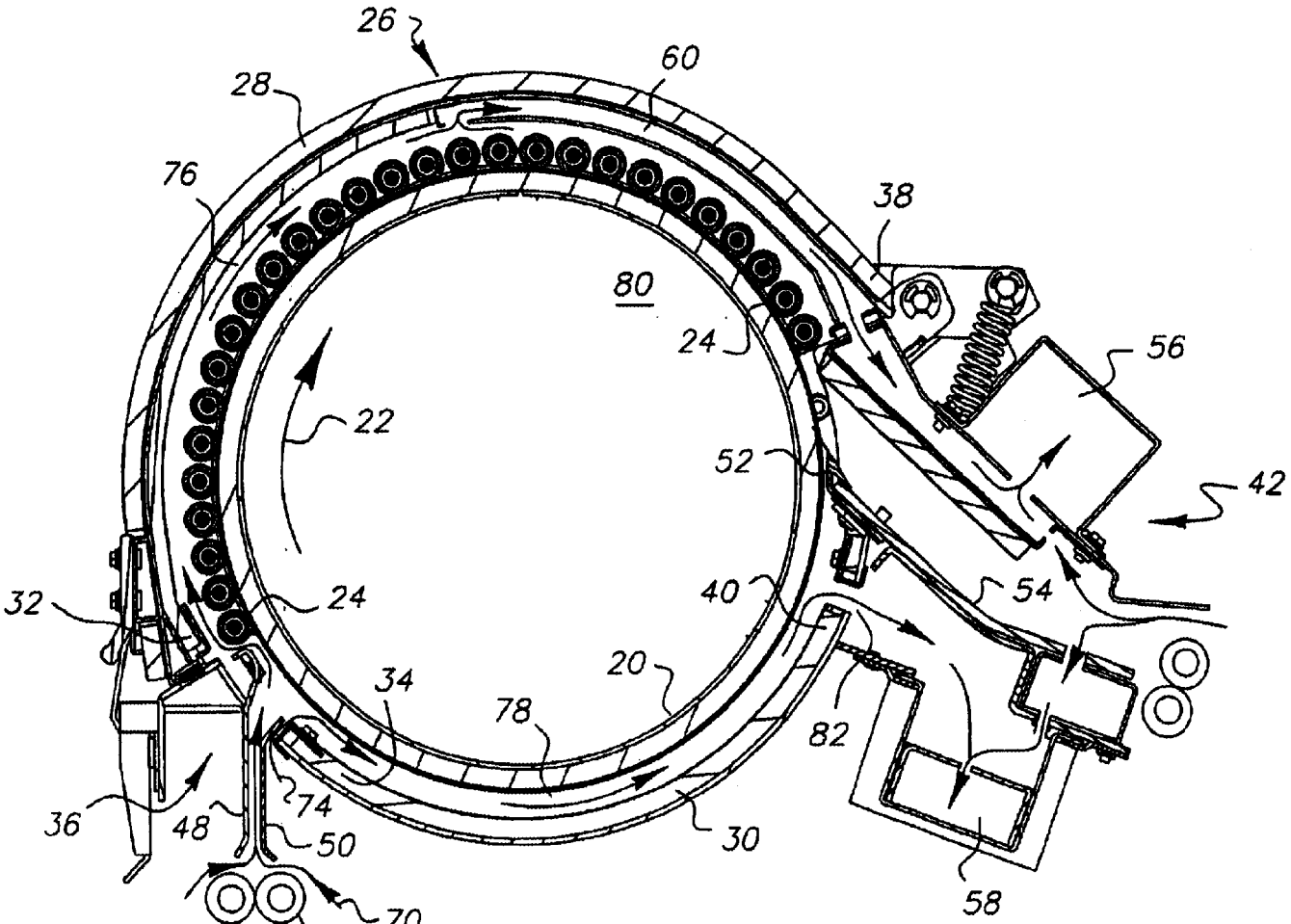
FIG. 2 is a side elevational view of the heated drum assembly of the processor of FIG. 1.

As shown in greater detail in FIG. 2, heated drum assembly 12 includes a heated drum 20 which rotates in direction 22, a plurality of rollers 24 circumferentially arrayed about a segment of drum 20 to hold an exposed media in contact with drum 20 and enclosure 26 enclosing drum 20 and rollers 22. Enclosure 26 includes a first upper curved cover member 28, spaced from rollers 22 and second lower curved member 30 spaced from and enclosing the lower portion of drum 20. Upper and lower members 28, 30 have respective first ends 32, 34 spaced from each other defining a media (film) entrance region 36 and respective second ends 38, 40 spaced from each other defining a media (film) exit region 42. Feed rollers 44, 46 and entrance guides 48, 50 feed an exposed film into contact with drum 20 under rollers 24. Film diverter 52 diverts film from contact with rollers 24 to exit over perforated felt pad 54. Top condensation trap 56, bottom condensation trap 58 and top internal duct 60 of member 28 form part of the airborne contaminant removal system of the present invention.

According to the present invention, airflow through heated drum assembly 12 is controlled to remove airborne contaminants produced during image development. In FIG. 2, ambient air is drawn into enclosure 26 at film entrance region 36. Arrows 70, 72, 74 denote ambient air input. The air is separated into top flow stream 76 and a bottom flow stream 78 separated by film entrance region 36 and film exit region 42.

A negative pressure (vacuum) field is applied at the air exit regions to drive flow. At the film entrance, ambient air splits into two streams moving into the upper and lower regions. The top air stream 76 filters air from the pressure roller region and processor cover member. This stream passes above the rollers 24 and out the top internal duct 60 near the film exit region 42. The duct plate 80 between the channel and film exit separates the top air stream 76 to maximize air flow overeat rollers 24 and minimize air pulled over the film from the processor film exit which can be a source of image artifacts (location where film loses contact from the drum 20 and starts to rapidly cool). A second air stream 78 runs below the drum 20 from the film entrance 36. As the film exits from the drum 20, airborne contaminants remain on the drum surface and out gas into the lower region. The lower air stream 78 sweeps out contaminants from that section where potentially high concentrations can exist. At the filtration exit region, condensation traps 56, 58 are designed to trap air contaminants by passing cool ambient air mixed with the hot processor air which causes condensation to occur. After the air is passed through the condensation region, it is further processed by special filter(s) 90 to remove contaminants and odor. Mixing ambient air in the condensation stage cools the air which increases the effectiveness and life of filters 90. Fan 112 established a negative air pressure to drive the air flows.

The bottom air stream 78 also aids in uniform temperature development of the film. For heat processable medical film, the metal drum 20 operates at a temperature, for example, of approximately 120+° C. and is heated by a circumambient (circumferentially uniform) resistive element heater attached to the drum 20. The film is designed to wrap around the drum 20 a certain length depending on design constraint and 180 degrees can be used. This wrap angle in combination with the drum's rotational velocity and diameter represent the total dwell time needed to adequately develop the film. Depending on the heat transfer properties of the different materials involved such as: film material, film thickness, drum material and drum thickness; the film generally takes a few seconds to warm up to the drum's operating temperature. This warm-up time typically represents a small percent of total dwell time.

The film used can draw relatively significant amounts of heat from the drum 20 surface as it first contacts the drum 20 and warms up. Circumambient heaters can cause locations of the drum 20 to under heat and over heat when film enters the processor. In locations of early film contact, where the most significant heat load takes place, the drum temperature can-decrease while in other locations the drum temperature can increase because it is not loaded as much. The temperature controller does not correct this. In a closed loop temperature control setup, the drum temperature can be controlled to a tight temperature variation at a location on the drum, but the overall drum temperature will still vary because of the non-even heat load as the film is applied to the drum. The location where the film does not wrap the drum will have the highest temperature readings. By passing cool air through this location (bottom flow stream 78), extra heat can be removed to help make the drum temperature more uniform.

The lower airflow stream 78 is designed to adjust flow rate depending if film is present. This is done by using the film to block some of the ambient air that mixes in the lower condensation trap. When film is present in the cooling section 14, the vacuum pressure in the lower duct increases because the ambient air passage is partially blocked. This increases the flow rate of the air in the lower duct, extracting more heat from the lower section of the drum when film is present which balances the drum's heat load better. This also conserves energy when the film is not present since the air flow under the drum 20 is reduced which reduces the duty cycle of the heater.

Air exits the drum regions at the top internal duct 60 and bottom drum outlet 82. As the film exits the drum, the majority of air contaminants are released from the film as it separates from the drum 20. Strong convective forces are present which lift the gasses. In this higher concentrated region above drum 20, airborne contaminants are removed at duct 60. Airborne contaminants are further removed a short distance from film diverter 52 with the traps 56 and 58.

Figure 3:
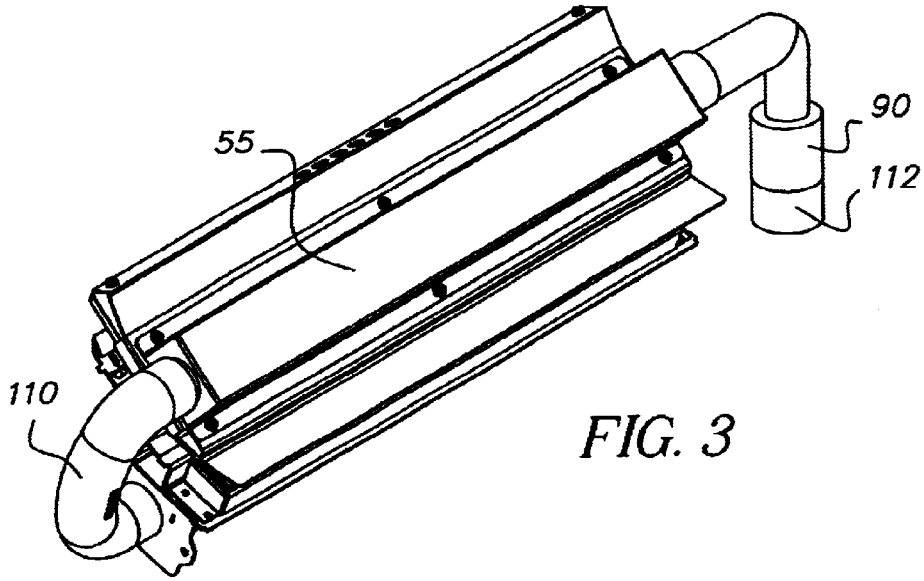
FIG. 3 is a perspective view of components of an embodiment of the present invention.
Figure 4:
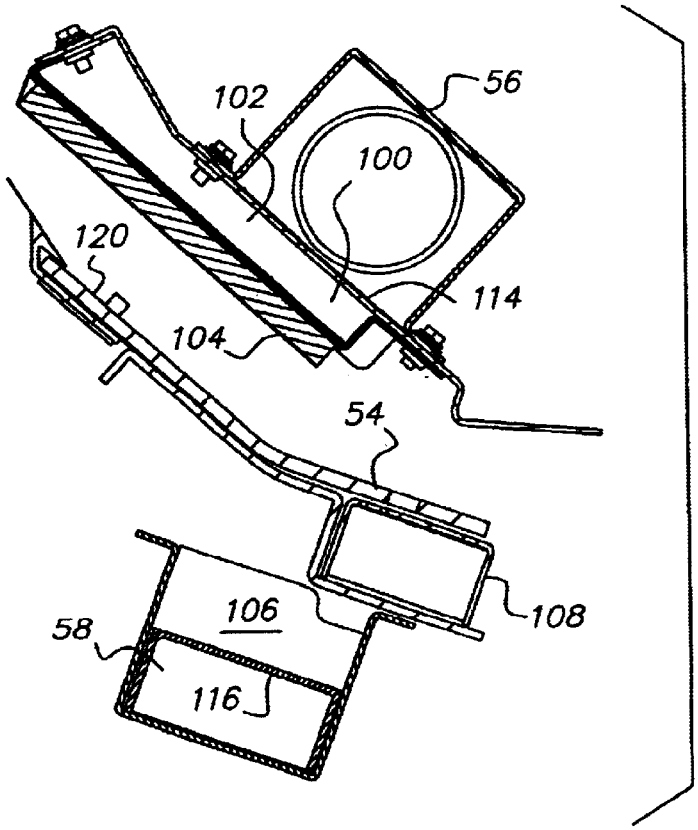
FIG. 4 is a side elevational view of components of an embodiment of the present invention.

The condensation traps 56, 58 are shown in FIGS. 3 and 4. Once the airborne contaminants enter the top condensation trap they are mixed with cooler ambient air in chamber 102 to enhance condensation. The insulation 104 of the top condensation trap 56 prevents image artifacts due to temperature gradients. Once the airborne contaminants enter the bottom condensation trap 58 it is mixed with cooler ambient air 106 to enhance condensation. The cooler air 106 flows through a perforated felt pad 54 and short cooling section 108. The top condensation trap 56 and bottom condensation trap 58 are constructed from a thermally conductive material. These traps 56, 58 are cooled by the ambient air and are attached to the main chassis, which acts as a heat sink.

The felt perforated pad 54 performs two basic functions 1) structural support as the film is transported along film path 120 and 2) a thermally non-conductive surface. As the film is transported in this region it must be supported because to the film has low beam strength. Film that is not guided may be subjected to stresses that may cause film wrinkles and creases. Film that is cooled rapidly and/or non-uniformly may cause image artifacts. The felt pad also acts as a thermal isolator preventing rapid cooling.

The air flows from the bottom condensation trap 58 through a molded rubber hose 110 to the top condensation trap 58 and then to the filtration system 90. The contaminant removal system requires 7.5 cfm (cubic feet per minute), for example, airflow measured at the fan 112 exhaust. The airflow is divided in half through pressure orifices located in the member 114 and the member of respective 116 condensation traps 56, 58. The airflow is further divided in the condensation traps 50% from the drum outlets and 50% from ambient air. Uniform airflow over the top and under the bottom of the processor drum 20 reduces any temperature gradients.

The airflow with respect to the perforated felt pad 54 is shown in FIG. 4. As the film travels over the perforated felt pad 54 it blocks the perforated holes and diverts the airflow to the bottom of the drum 20. This balances the thermal loading of the top and bottom of the drum surface, which decreases drum 20 temperature variations. During idle conditions the air flows through the perforated felt pad 54 mixing cooler air into the condensation traps 56, 58.

The invention has been described in detail with particular reference to certain preferred embodiments thereof, but it will be understood that variations and modifications can be effected within the spirit and scope of the invention.

Parts List

10 thermal processor
12 heated drum assembly
14 film cooling section
16 densitometer
18 airborne contaminant removal system

20 heated drum
22 direction
24 rollers
26 enclosure
28,30 curved cover member
32,34 first ends
36 film entrance region
38,40 second ends
42 region
44,46 rollers
48,50 entrance guides
52 film diverters
54 perforated felt pad
56 top condensation trap
58 bottom condensation trap
60 top internal duct
70,72,74 arrows
76 top air stream
78 bottom air stream
80 duct plate
82 bottom drum outlet
90 special filters
102 chamber
104 insulation
106 cooler ambient air
108 short cooling section
110 molded rubber hose
112 fan
114 top orifice
116 bottom orifice

What is claimed is:

1. A thermal processor having a contaminant removal system comprising:

a heated drum for heat developing exposed heat developable media which emit air-borne contaminants during said development;

a plurality of rollers located about a circumferential segment of said drum to hold an exposed media in contact with said drum;

an enclosure for enclosing said heated drum and plurality of rollers, said enclosure including a first upper curved member spaced from and enclosing said rollers and the upper portion of said drum and a second lower curved member spaced from and enclosing said lower portion of said drum, said first and second curved members having first ends spaced from each other and defining a film entrance region, and further having second ends spaced from each other and defining a film exit region;

wherein said first upper curved member includes a curved duct having a first opening above said rollers and a second opening configured to direct gaseous fluids away from the film exit from said drum;

a top condensation trap communicating with said second opening of said duct;

a bottom condensation trap; and an air flow control system for drawing ambient air from outside said enclosure through said film entrance region, splitting said air flow into (a) a top flow stream which passes between said first member over said rollers, through said duct and through said top condensation trap where airborne contaminants are condensed and said air stream is cooled, and (b) a bottom flow stream which passes between said second member and said lower portion of said drum and through said bottom condensation trap where airborne contaminants are condensed and said bottom flow stream is cooled.

2. The thermal processor of claim 1 wherein top condensation trap and said bottom condensation trap are connected together to form a continuous path for said top and bottom and air flow streams.

3. The thermal processor of claim 1 including a filtration system connected to said traps for filtering said air flow passing through said traps.

4. The thermal processor of claim 1 wherein said air flow control system includes an air mover system for creating a negative air pressure to draw air through said air flow system.

5. The thermal processor of claim 1 wherein said airflow control system draws ambient air from outside said traps into said traps to cool the air passing through said traps.

6. The thermal processor of claim 5 including a film diverter located at said film exit for removing developed film from contact with said heated drum, a perforated felt pad for supporting film after removal from said drum, said pad being in air communication with said bottom condensation trap, wherein when film travels over said felt pad, said perforations are blocked and said airflow is diverted to the bottom of the drum to decrease drum temperature variations.

* * * * *